United States Patent [19]

Terbrusch et al.

[11] Patent Number: 5,004,114

[45] Date of Patent: Apr. 2, 1991

[54] TRASH CAN WITH TETHERED COVER

[76] Inventors: Rosemarie Terbrusch, R.D. 4 Blueberry La., South Salem, N.Y. 10590; George Spector, 233 Broadway #3815, New York, N.Y. 10007

[21] Appl. No.: 430,783

[22] Filed: Nov. 2, 1989

[51] Int. Cl.[5] ..... B65D 55/16; B65D 41/06

[52] U.S. Cl. ..... 220/296; 220/85 CH; 220/375; 220/730; 220/908; 206/459

[58] Field of Search ..... 220/1 T, 85 CH, 375, 220/296; 206/459

[56] References Cited

U.S. PATENT DOCUMENTS

| | | | |
|---|---|---|---|
| 3,181,725 | 3/1963 | Friedl | 220/375 |
| 3,361,290 | 1/1968 | Matthews | 220/296 |
| 3,393,824 | 2/1967 | Appleton | 220/375 |
| 3,844,443 | 10/1974 | Cudzik | 220/296 |
| 4,245,754 | 1/1981 | Ellis | 220/296 |
| 4,558,796 | 12/1985 | Jaicks | 220/1 T |
| 4,666,054 | 5/1987 | Jaicks | 220/1 T |
| 4,723,686 | 2/1988 | Pennisi | 220/1 T |
| 4,776,486 | 10/1988 | Mizusawa | 220/375 |

OTHER PUBLICATIONS

The Bead Chair Mfg. Co. Product data, 2/1953.

*Primary Examiner*—Stephen Marcus
*Assistant Examiner*—S. Castellano

[57] ABSTRACT

A trash container with a tightly secured cover is provided in which a first engaging structure disposed on outer surface about an open top of a pail interlocks with a second engaging structure disposed on inner surface of a depending skirt of the cover to tightly secure the cover to the open top of the pail so that it will prevent an animal from entering through the open top and eat the trash therein.

1 Claim, 1 Drawing Sheet

TRASH CAN WITH TETHERED COVER

BACKGROUND OF THE INVENTION

The instant invention relates generally to garbage cans and more specifically it relates to a trash container with a tightly secured cover.

There are available conventional garbage cans of various designs but which do not provide the novel improved functions and structure of the invention herein disclosed.

SUMMARY OF THE INVENTION

A primary object of the present invention is to provide a trash container with a tightly secured cover that will overcome the shortcomings of the prior art devices.

Another object is to provide a trash container with a tightly secured cover in which the cover is turned about top end of a pail to lock in place so that it will prevent an animal from entering therein.

An additional object is to provide a trash container with a tightly secured cover that is rotatably carried on a hinged U-shaped arm connected to side of the pail to prevent loss of the cover when unscrewed from the top end.

A further object is to provide a trash container with a tightly secured cover that is simple and easy to use.

A still further object is to provide a trash container with a tightly secured cover that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
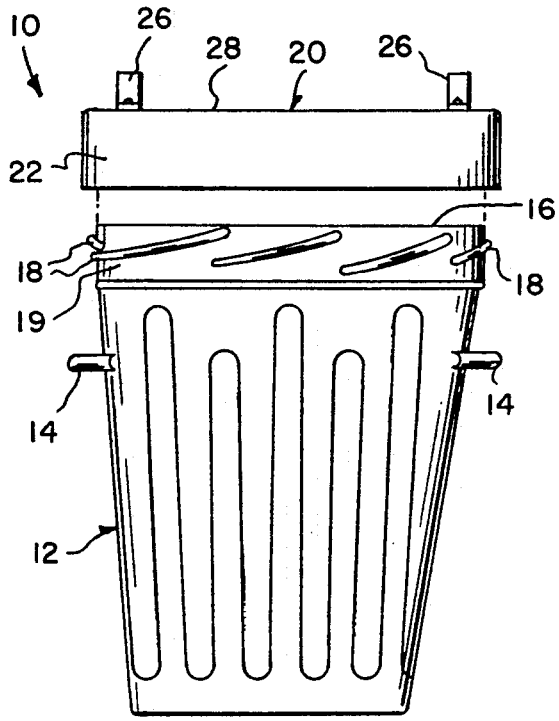
FIG. 1 is an elevational view of the invention with the cover ready to be attached thereto.
Figure 2:
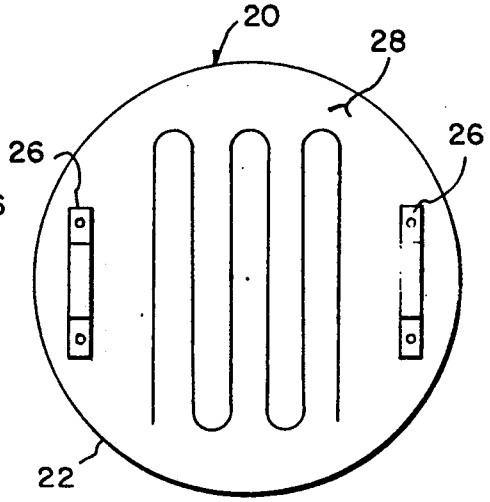
FIG. 2 is a top view of the cover showing the grip handles thereon.
Figure 3:
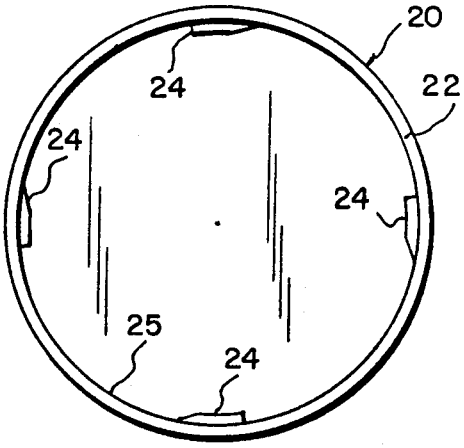
FIG. 3 is a bottom view of the cover showing the lug wedge shaped members therein.

Turning now descriptively to the drawings, in which similar reference characters denote similar elements throughout the several views, FIG. 1 illustrates a trash container 10 consisting of a pail 12 having a pair of carry handles 14 and an open top 16 for receiving trash therein. A plurality of interrupted twist threads 18 are disposed on outer surface 19 about the open top 16 of the pail 12. A cover 20, as shown in FIGS. 1, 2 and 3, has a depending skirt 22 being of a size to fit about the open top 16 of the pail 12. A plurality of lug wedge-shaped members 24 are disposed on inner surface 25 of the depending skirt 22 of the cover 20 and are adapted to interlock with the interrupted twist threads 18 by rotation of the cover 20 in a place substantially perpendicular to the vertical axis of the pail 12 over which the cover 20 is placed. This will tightly secure the cover 20 to the open top 16 of the pail 12 so that it will prevent an animal from entering through the open top 16 of the pail 12 to eat the trash therein.

The cover 20 further includes a pair of spaced apart grip handles 26 affixed to the top surface 28 thereof so that a person can easily twist the cover 20 on and off the open top 16 of the pail 12.

Figure 4:
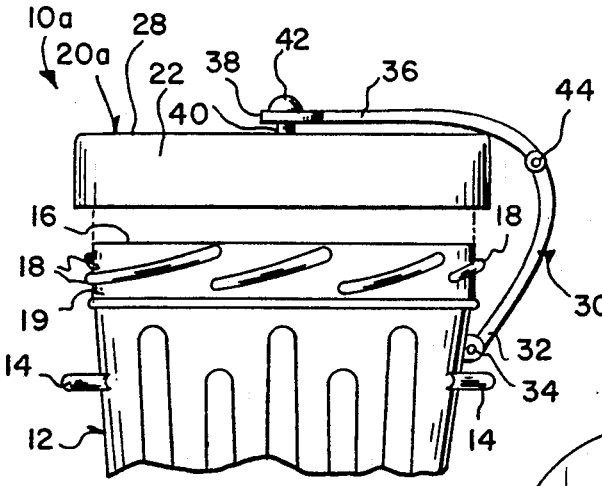
FIG. 4 is an elevational view similar to FIG. 1, with parts broken away showing a modification in which the cover is rotatably carried on a hinged U-shaped arm connected to side of the pail.
Figure 5:
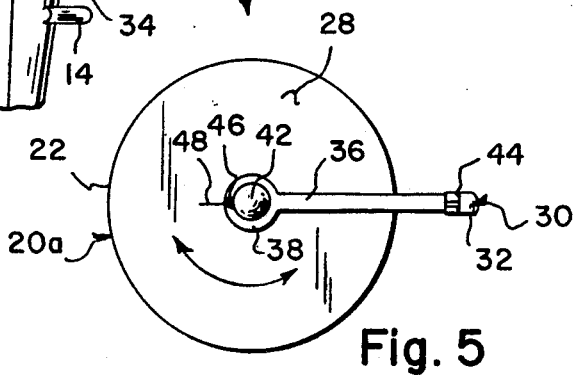
FIG. 5 is a top view of the cover in FIG. 4 showing a marker line on the cover and a pointer on the washer portion of the U-shaped arm.

FIGS. 4 and 5 show a modified container **10*a* containing a U-shaped arm 30 having a distal end 32 pivoted at 34 below the twist threads 18 while a proximate end 36 terminates into a washer-like portion 38. A pivot pin 40 having an enlarged head 42 fits through the washer-like portion of the U-shaped arm 30 and into center of the cover 20*a*, allowing the cover to rotate thereabout. A hinge 44 is disposed between the distal end 32 and the proximate end 36 of the U-shaped arm 30 to enhance bendability feature thereof when the cover 20*a* is removed from the open top 16 of the pail 12**.

A pointer 46 is disposed onto the washer-like portion 38 while a marker line 48 is disposed onto the top surface 28 of the cover **20*a* extending radially from the pivot pin 40. When the marker line 48 lines up with the pointer 46 to indicate that the lug wedge-shaped members 24 are in proper alignment with the twist threads 18 when the cover 20*a* is placed over the open top 16 of the pail 12**.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A trash container comprising:

(a) a pail with a vertical axis having a pair of carry handles and an open top for receiving trash therein;

(b) a first engaging means disposed on outer surface about the open top of said pail;

(c) a cover having a center and a depending skirt being of a size to fit about the open top of said pail;

(d) a second engaging means disposed on inner surface of the depending skirt of said cover and adapted to interlock with said first engaging means to tightly secure said cover to the open top of said pail so that it will prevent an animal from entering through the open top of said pail to eat the trash therein; wherein said first engaging means is a plurality of interrupted twist threads while said second engaging means is an appropriately aligned plurality of lug wedge shaped members which are interlocked by rotation of said cover in a plane substantially perpendicular to the vertical axis of said pail over which said cover is placed; further comprising:

(e) a U-shaped arm having a distal end pivoted about a horizontal axis to side of said pail below said twist threads and a proximate end which terminates into a washer-like portion;

(f) a pivot pin having an enlarged head fits through the washer-like portion of said U-shaped arm and into center of said cover, allowing said cover to rotate about said vertical axis;

(g) a hinge connecting said distal end and said proximate end whereby said proximate end can bend away from said pail for removal of said cover;

(h) a pointer disposed onto the washer-like portion; and (i) a marker line disposed onto the top surface of said cover extending radially from said pivot pin so as to line up with said pointer to indicate that said lug wedge-shaped members are in proper alignment with said twist threads when said cover is placed over the open top of said pail.

* * * * *